United States Patent [19]

Thomas et al.

[11] Patent Number: 4,627,768

[45] Date of Patent: Dec. 9, 1986

[54] LOCKING DEVICE FOR OIL PLATFORMS

[75] Inventors: Pierre-Armand Thomas, Puteaux; Jean-Claude Naudin, Paris, both of France

[73] Assignee: Technip Geoproduction, Paris la Defense, France

[21] Appl. No.: 706,749

[22] Filed: Feb. 28, 1985

[30] Foreign Application Priority Data

Feb. 28, 1984 [FR] France ..... 84 03066

[51] Int. Cl.[4] ..... E02B 17/08; B66F 1/00

[52] U.S. Cl. ..... 405/198; 405/196; 254/95; 254/105

[58] Field of Search ..... 405/196–199; 254/89 R, 95, 105–111; 24/524

[56] References Cited

U.S. PATENT DOCUMENTS

| | | | |
|---|---|---|---|
| 3,278,158 | 10/1966 | Saldana | 254/106 |
| 3,343,371 | 9/1967 | Heitkamp . | |
| 3,722,863 | 3/1973 | Itoh et al. | 254/105 |
| 4,255,069 | 3/1981 | Goldman et al. | 405/198 X |

FOREIGN PATENT DOCUMENTS

| | | | |
|---|---|---|---|
| 2203768 | 5/1974 | France . | |
| 58-44115 | 3/1983 | Japan . | |
| 160427 | 9/1983 | Japan | 405/196 |
| 2077843 | 6/1981 | United Kingdom . | |

*Primary Examiner*—Cornelius J. Husar
*Assistant Examiner*—Nancy J. Stodola
*Attorney, Agent, or Firm*—Wenderoth, Lind & Ponack

[57] ABSTRACT

The locking device for a self-raising oil platform comprising a shell (1) mounted to be movable along legs (2) by means of raising mechanisms comprising output gear pinions cooperative with racks (3) mounted on at least a part of the length of the legs (2), comprises a toothed member (6) forming a counter-rack (6*a*) mounted on the shell of the platform, means (7) for shifting the toothed member (6) transversely of the direction of the rack with which the device is associated for engaging the teeth of the toothed member in the teeth of the rack (3) or for disengaging them from the teeth of the rack, clamping plates (13) connected to the toothed member and clamping counter-plates (15) connected to the platform, and means (20) for clamping the plates and counter-plates together so as to lock the toothed member (6) in position in the rack.

10 Claims, 5 Drawing Figures

LOCKING DEVICE FOR OIL PLATFORMS

The present invention relates to off-shore oil-well platforms, and more particularly to self-raising platforms.

Self-raising platforms are usually disposed on legs driven into the bottom of the drilling site and along which a shell or hull is mounted to be movable by driving mechanisms provided with gear pinions cooperating with racks mounted along said legs.

When the self-raising platform is stopped, it must be locked relative to the legs so as to avoid dynamic overloads due to the swell of the sea and subjecting the legs alternately, which increases the stresses and consequently the fatigue.

Indeed, as the shell of the platform bears on the legs through rack-and-pinion assemblies, the static reaction load is amplified by the fact that the members have a tendency to move relative to each other in a differential manner.

Consequently, these cyclic forces which produce considerable distorsions in a lattice,produce localized stresses, termed "secondary stresses", which are in fact of the same order of magnitude as the main stresses.

In order to achieve a good performance of the lattices, the component elements which are part of their construction must be overdimensioned.

In fact, there are two ways of balancing a bending moment on a mast of such a platform.

(a) The balancing is ensured by a horizontal abutment between two guide levels, the vertical loads being taken by the self-raising mechanisms.

(b) The balancing is achieved by a vertical locking of the members on the lattices and by taking the outer shear force on the support guide, as the vertical forces of the weight proper are always taken by the mechanisms in the case of an independent locking system, or by the locking system itself if a self-locking system is chosen.

The locking devices for oil-well platforms existing at the present time require considerable mechanical wedging systems so as to take up play due, for example, to lack of uniformity in the position of the various legs of the platform driven into the ground.

Further, the known devices cannot be instantaneously unlocked and require the intervention of many workmen or complex equipment.

An object of the invention is therefore to overcome the aforementioned drawbacks of conventional devices by providing a locking device for self-raising oil-well platforms which is of relatively simple construction and permits a rapid locking subsequent to a displacement of the platform, and a rapid unlocking, either for a subsequent displacement or for adjusting the level.

The invention therefore provides a locking device for a self-raising oil-well platform comprising a shell mounted to be movable along legs by means of raising mechanisms comprising output gear pinions cooperative with racks mounted on at least a part of the length of the legs, said device comprising a toothed member constituting a counter-rack mounted on the shell of the platform, means for displacing said toothed member transversely of the direction of the rack with which the device is associated for engaging the teeth of said toothed member in the teeth of the rack or for disengaging them from the teeth of the rack, clamping plates connected to said toothed member and clamping counter-plates connected to said platform, and means for clamping said plates and counter-plates and ensuring the locking of said toothed member in position on said rack.

A better understanding of the invention will be had from the following description which is given solely by way of example with reference to the accompanying drawings, in which.

Figure 1:
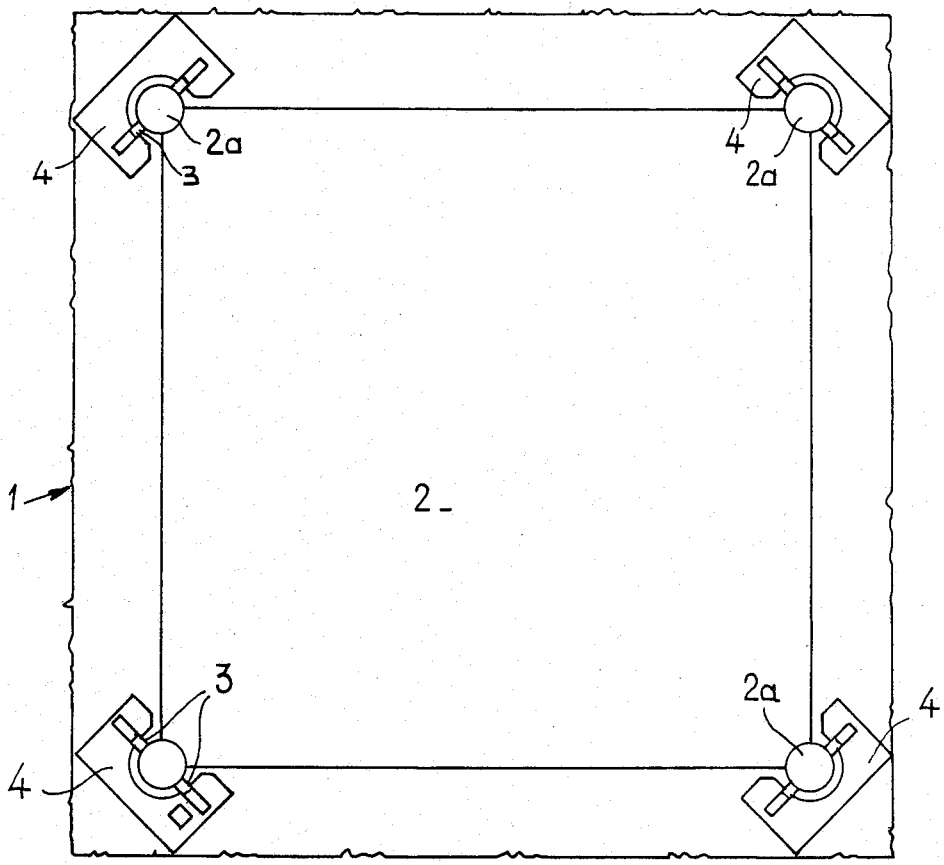
FIG. 1 is a diagrammatic plan view of a self-raising platform to which the locking device according to the invention is applied.
Figure 5:
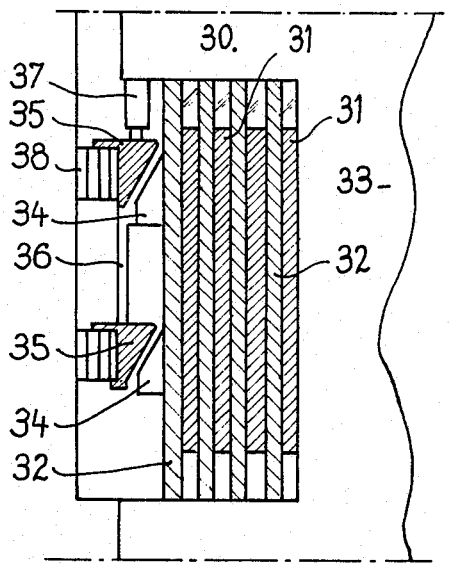

FIG. 5 is a diagrammatic sectional view of a modification of a platform locking device according to the invention. de FIG. 1 shows in plan a part of a self-raising oil-well platform comprising a shell element 1 mounted to be movable along vertical legs 2 here composed of four web-girders 2*a* driven into the ground of the site at which the platform is placed.

The legs 2 of the platform are provided with diametrically opposed racks 3 (FIG. 4) disposed on a part of the length of the legs 2 and with which are adapted to cooperate output gear pinions of drive mechanisms (not shown) mounted on the shell 1. Six output pinions may be provided for each platform leg.

As can be seen in FIG. 1, the shell 1 has a roughly square shape and includes at its four corners housings 4 each adapted to receive a locking device according to the invention.

The locking device associated with a corner of the platform shown in FIG. 1 will now be described with reference to FIGS. 2 to 4.

This device comprises a toothed member 6 provided with a counter-rack 6*a* adapted to cooperate with a corresponding rack 3 mounted in the leg 2.

The toothed member 6 constituting a counter-rack is mounted to be movable in a direction perpendicular to the rack by jacks 7 whose rods 8 are pivoted to lateral forks 9 of the member 6 so as to permit the engagement of the teeth of the counter-rack 6*a* in the teeth of the rack 3 when the shell is locked in position and the teeth of the counter-rack 6*a* are withdrawn from the rack 3 for unlocking the shell. The rods 8 of the jacks 9 also include an intermediate pivot 8*a* for compensating for the effects of the movements of the toothed member 6 on the distance between the racks 7.

The cylinders 10 of the jack 7 are pivoted to fixed points on the shell (not shown).

The toothed member 6 has lateral walls 11 perpendicular to the counter-rack 6*a* and defining therebetween a cavity 12 for rectangular clamping plates 13 which are freely mounted between the lateral walls 11 and maintained between these walls by flanges 14.

Interposed between the plates 13 are other plates 15 disposed in a mount 16 connected to the shell of the platform. They are disposed in their mount in such manner as to be freely movable in a direction transverse to the direction of displacement of the toothed member 6. As can be seen in particular in FIGS. 2 and 4, the plates 13,or braking plates,and the counter-braking plates 15 are four in number.

The locking device further comprises two tightening jacks 20 adapted to apply the plates 13 and the counter-plates 15 against each other. The jacks 20 are connected to the shell of the platform. In the presently-described embodiment, it concerns hydraulic jacks.

The body 21 of each jack bears against the shell through cushions 22 made from an elastomer or from teflon.

Figure 4:
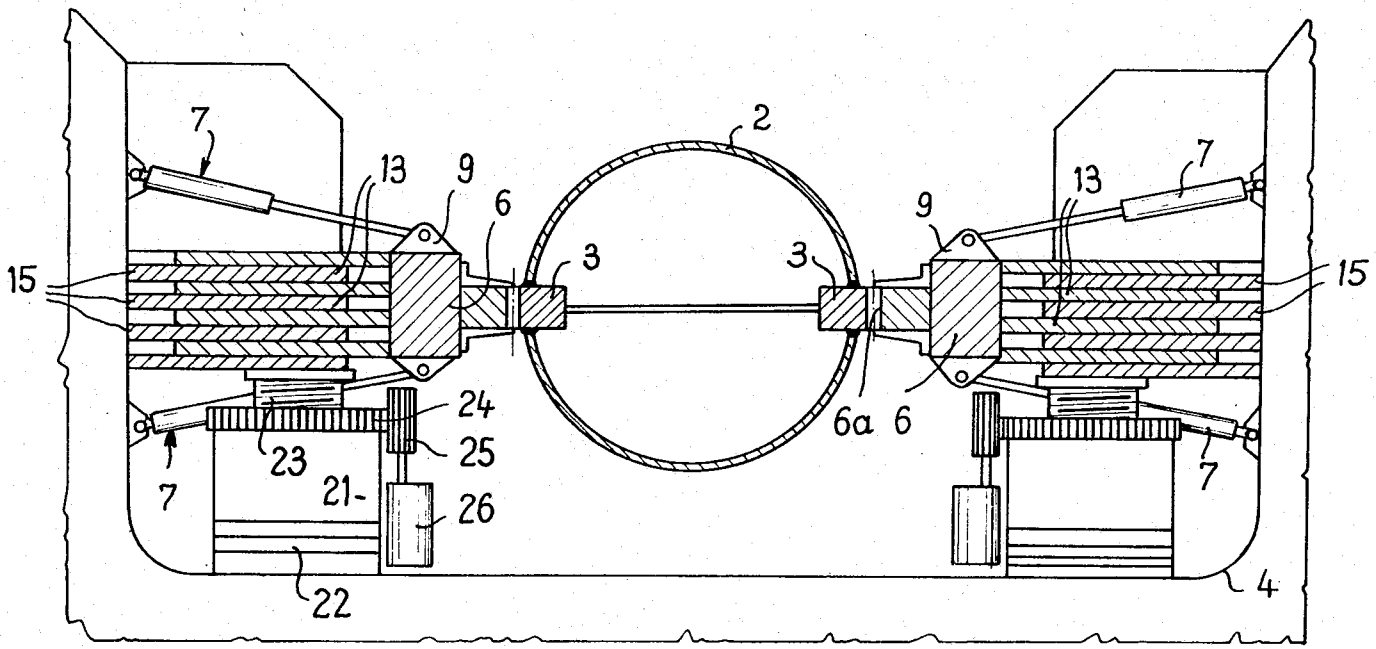
FIG. 4 is a partial cross-sectional view of a platform showing a locking device according to the invention associated with each rack of a platform leg.

The rod 23 of the jack which forms a push-rod for the counter-plates,can be locked by means of a nut connected to a gear wheel 24 which is engaged with an output gear pinion 25 of an electric motor 26 (FIG. 4).

As shown in FIG. 4, as each member 2*a* of the platform is provided with two diametrically opposed racks 3, a locking device according to the invention is provided in association with each of these racks.

Opposite the tightening jacks 20, the device comprises a fixed abutment plate 27 constituting the equivalent of a disc brake shoe.

In the embodiment just described, the brake plates 13 and the brake counter-plates 15 are made from steel.

Their coefficients of friction may also be increased by providing on the surfaces of said plates linings of a friction material.

Figure 3:
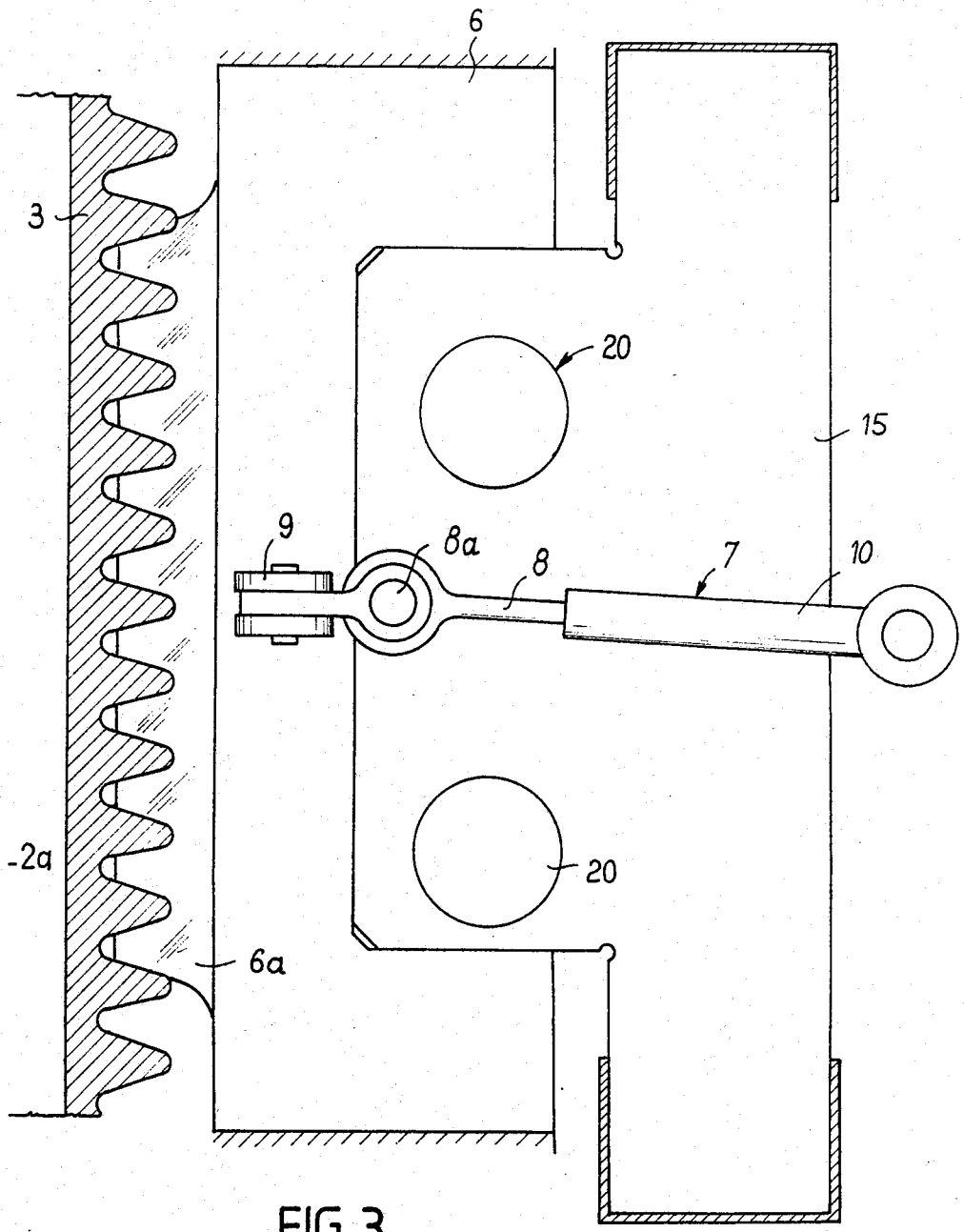
FIG. 3 is an elevational view of the device shown in FIG. 2 engaged with a rack of a platform leg.

The device just described operates in the following manner :

When the platform is in the operating position or in a towing position, the main elements of the locking devices provided for the legs of the platform occupy the relative positions shown in FIG. 3 As can be seen in this Figure, the double-acting jacks 7 apply the toothed member 6 against the corresponding rack 3. The toothed member is automatically positioned in confronting relation to the teeth of the rack owing to the complementarity of the shapes of the teeth of the considered elements.

The member 6 drives therewith the clamping plates 13 which are adjusted inside this member. These plates slide between the counter-plates 15 interposed therebetween with a slight clearance of a few millimetres. The member 6 provided with its plates slides along a bearing surface 28 of the abutment 27 (FIG. 2) which performs the function of a brake shoe.

As soon as the member 6 is in such position that the teeth of the counter-rack 7 are engaged in the corresponding teeth of the rack 3 (FIG. 3), the tightening jacks 20 are actuated and cause the plates 13 and counter-plates 15 to be compressed against the abutment 27 constituting a shoe, the bodies of the jacks 20 bearing against the cushions 22 of elastomer or teflon. There is thus produced a tightening between the plates 13 and the counter-plates 15 which locks the shell of the platform in position. In assuming that eight friction surfaces are in contact and bearing in mind that the mean coefficient of friction of steel-against-steel is 0.2 or is 0.3 if the counter-plates 15 and the abutment 27 are applied with a component having a high coefficient of friction, if F is the compressing force exerted by the jacks and $V_b$ is the vertical locking force, there is obtained:

$$V_b=(2\times F\times 0.2\times 8)\times 2=6.4\ F$$

or $$V_b\ \text{friction}=(2\times F\times 0.3\times 8)\times 2=9.6\ F$$

This value is given for one leg or member, which represents for jacks whose nominal force is 750 T, $V_b$=4800 T or $V_b$ friction=7200 T.

In the hypothesis of a square lattice structure having eleven metres between the axes of the members, this enables a dynamic moment having the following value to be supported:

$$M\ \text{dyn.}\ V_b=4800\times 11\times 1.414=74\ 659\ \text{mT}$$

or $$M\ \text{dyn.}\ V_b\ \text{friction}=4200\times 11\times 1.414=111\ 989\ \text{mT}$$

It will be understood that the number of plates of the locking device may be adapted to the dynamic moment to be balanced.

When the hydraulic jacks 20 are in action and the sets of plates 13 and counter-plates 15 are clamped against the abutment 27 constituting a shoe and the elastomers are compressed, for example by about 30 mm, the motorized nut driven by the gear wheel 24 of the jack is wedged in a position of abutment on the body of the jack. The hydraulic jack can then be released and the reaction of the system then passes through the safety nut. The presence of the cushions of elastomer 22 ensures in this case the permanency of the reaction and renders negligible the affect of a small re-entry of the piston when the reaction forces are taken by the safety nut driven by the gear wheel 24. The system is therefore completely reliable and requires no permanent hydraulic fluid supply.

The device is unlocked in the same way by reversing the procedure. The jacks 20 are actuated by applying thereto a fluid pressure slightly higher than the positioning pressure which ensures the unlocking of the motorized safety nuts 24. The latter can then be unscrewed. The rods 23 of the jacks can then be retracted, which decompresses the cushions of elastomer 22 and the plates 13 are released from the counter-plates 15. The double-acting jacks 7 can then shift the toothed member 6 rearwardly so as to disengage the teeth of the counter-rack 6*a* from the teeth of the rack 3.

The considered leg is then unlocked.

The device just described has sequences of operation which may be automatized. The locking device shown in FIG. 5 constitutes a modification of the device described with reference to FIGS. 2 to 4.

Figure 2:
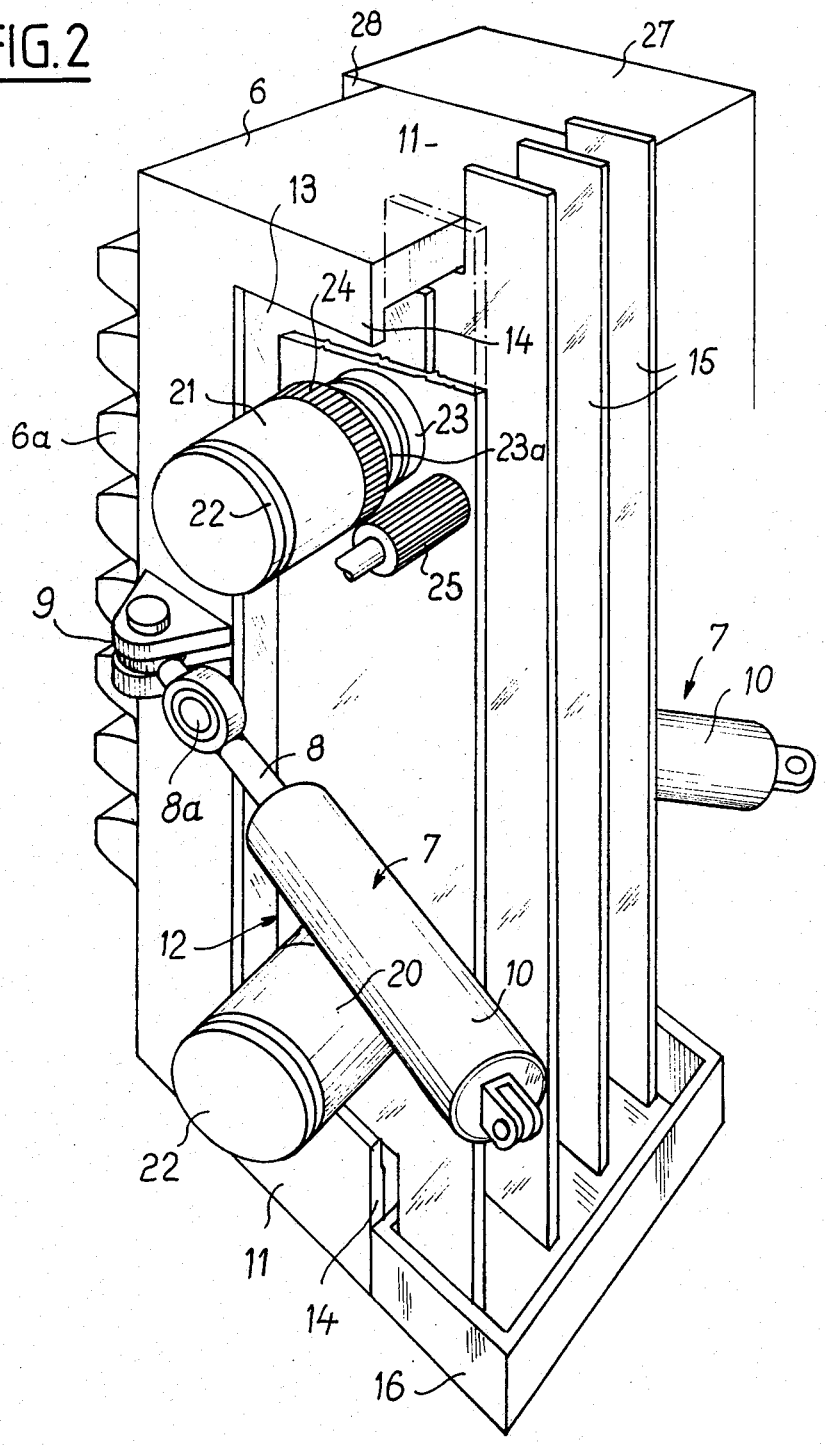
FIG. 2 is a perspective view of a first embodiment of the locking device according to the invention.

In the same way as the device shown in FIG. 2, it comprises a toothed member 30 whose toothed part,-which forms a counter-rack adapted to cooperate with a rack of a leg or member of the platform,has not been shown. Mounted in the member 30 with clearance are tightening plates 31 which cooperate with tightening counter-plates 32 disposed in a fixed mount connected to the platform. The tightening counter-plates 32 bear against an abutment 33 constituting a brake shoe. The counter-plate 32 opposed to that bearing against the abutment 33 comprises tapered blocks 34 adapted to cooperate with blocks 35 having a complementary inclination and connected together by a brace 36 and actuated by a double-acting jack 37. The tapered blocks 35 bear against the shell through cushions 38 of elastomer or teflon.

Such a device operates in a similar manner to that described with references to FIGS. 2 to 4, except that the tightening of the plates 31 and counter-plates 32 is ensured by the tapered blocks 34, 35 under the action of the double-acting jack 37.

In order to ensure a positive safety of such an arrangement, the jack 37 must be provided with a motorized nut similar to that employed in the tightening jacks 20 of the embodiment shown in FIG. 2.

Although in the modification shown in FIG. 5 there is employed a hydraulic jack 37 for actuating the tapered blocks, it is also possible to envisage a solution of of the self-lockable type which does not use a hydraulic jack, but employs for controlling the tapered blocks the weight of the shell. For the descent of the shell, there would then be produced a relative sliding between the blocks which would bring about the locking procedure.

The non-driving of the blocks would be ensured by a controlled lug.

In order to unlock the platform, it would be necessary to raise the shell so as to disengage the driving lug, slide the blocks by disengaging the toothed locking member which would then be returned rearwardly by jacks similar to the jacks 7 of the embodiment shown in FIG. 2.

What is claimed is:

1. A locking device in combination with a self-raising oil platform which comprises legs, a shell mounted to be movable along the legs, raising mechanisms for moving the shell along the legs including racks mounted on at least a part of the length of the legs, said device being associated with each rack and comprising a toothed member having a part constituting a counter-rack mounted on the shell of the platform, means for displacing said toothed member transversely of the rack with which the device is associated for selectively engaging the teeth of said toothed member in the teeth of the rack and disengaging them from the teeth of the rack, clamping elements constituting plates connected to said toothed member, clamping elements constituting counter-plates connected to said platform, said plates and counter-plates having interengageable surfaces contained in parallel planes and being freely relatively movable in a given direction substantially perpendicular to said planes between a first position in which they are spaced apart and a second position in which said surfaces are interengaged, and means cooperative with the plates and counterplates for clamping substantially in said given direction said plates and counter-plates in said second position and ensuring the locking of said toothed member in position on said rack.

2. A locking device according to claim 1, wherein the clamping plates and the clamping counter-plates are made from steel.

3. A locking device according to claim 1, wherein the clamping plates and clamping counter-plates are provided with interengageable linings having a high coefficient of friction.

4. A locking device according to claim 1, wherein said means for clamping said plates and counter-plates comprise jack means for selectively exerting a clamping pressure on the plates and counter-plates substantially in said given direction and releasing said clamping pressure.

5. A locking device combination with a self-raising oil platform which comprises legs, a shell mounted to be movable along the legs, raising mechanisms for moving the shell along the legs including racks mounted on at least a part of the length of the legs, said device being associated with each rack and comprising a toothed member having a part constituting a counter-rack mounted on the shell of the platform, means for displacing said toothed member transversely of the direction of the rack with which the device is associated for selectively engaging the teeth of said toothed member in the teeth of the rack and disengaging them from the teeth of the rack, clamping elements constituting plates connected to said toothed member, clamping elements constituting counter-plates connected to said platform, and means for clamping said plates and counter-plates and ensuring the locking of said toothed member in position on said rack, said toothed member comprising, on each side of said part constituting a counterrack, lateral walls defining a cavity having flanges for retaining said clamping plates which are freely mounted in said cavity, an abutment plate forming a brake shoe, the toothed member being mounted to be slidable against said abutment plate, and double-acting jacks connected to the toothed member for moving the toothed member between a position in which the counter-rack is engaged with the rack of the corresponding leg and a position in which the counter-rack is disengaged from said rack.

6. A locking device in combination with a self-raising oil platform which comprises legs, a shell mounted to be movable along the legs, raising mechanisms for moving the shell along the legs including racks mounted on at least a part of the length of the legs, said device being associated with each rack and comprising a toothed member having a part constituting a counter-rack mounted on the shell of the platform, means for displacing said toothed member transversely of the direction of the rack with which the device is associated for selectively engaging the teeth of said toothed member in the teeth of the rack and disengaging them from the teeth of the rack, clamping elements constituting plates connected to said toothed member, clamping elements constituting counter-plates connected to said platform, and means for clamping said plates and counter-plates and ensuring the locking of said toothed member in position on said rack, the clamping means for the plates and the counterplates comprising at least a hydraulic jack having a body which bears against the shell of the platform through packing blocks of a resiliently yieldable material and having a rod which is in contact with one clamping element of said clamping elements, which one clamping element is in confronting relation to the jack, another clamping element of said clamping elements which is the most remote from the rod of the jack being in contact with the abutment plate constituting a brake shoe.

7. A locking device according to claim 6, wherein said jack of the clamping means is provided with a safety device comprising a motorized nut cooperative with a screwthread of the rod of said jack of the clamping means and adapted to bear against the body of said jack of the clamping means so as to withstand a reaction of the clamping plates and counter-plates when the pressure of the hydraulic fluid supplied to said jack of the clamping means is released.

8. A locking device in combination with a self-raising oil platform which comprises legs, a shell mounted to be movable along the legs, raising mechanisms for moving the shell along the legs including racks mounted on at least a part of the length of the legs, said device being accociated with each rack and comprising a toothed member having a part constituting a counter-rack mounted on the shell of the platform, means for displacing said toothed member transversely of the direction of the rack with which the device is associated for selectively engaging the teeth of said toothed member in the teeth of the rack and disengaging them from the teeth of the rack, clamping elements constituting plates connected to said toothed member, clamping elements constituting counter-plates connected to said platform, and means for clamping said plates and counter-plates and ensuring the locking of said toothed member in position on said rack, the clamping means for the plates and counter-plates comprising first beveled blocks connected to a counter-plate and complementary second beveled blocks which are cooperative with the first beveled blocks and are movable in a direction parallel to planes of the plates and counter-plates, and a double-acting jack for moving the second beveled blocks in said direction, the blocks movable by said jack bearing against a fixed wall of the shell through cushions of elastically yieldably material.

9. An oil platform comprising legs, a shell suported by the legs, and shell-raising mechanisms including racks on at least a portion of the lengths of the legs, there being provided at least one locking device associated with the rack on each leg of the platform, said device comprising a toothed member having a part constituting a counter-rack mounted on the shell of the platform, means for displacing said toothed member transversely of the rack with which the device is associated for selectively engaging the teeth of said toothed member in the teeth of the rack and disengaging them from the teeth of the rack, clamping plates connected to said toothed member, clamping counter-plates connected to said shell, said plates and counter-plates having interengageable surfaces contained in parallel planes and being freely relatively movable in a given direction substantially perpendicular to said planes between a first position in which they are spaced apart and a second position in which said surfaces are interengaged, and means cooperative with the plates and counter-plates for clamping substantially in said given direction said plates and counter-plates in said second position and ensuring the locking of said toothed member in position on said rack.

10. An oil platform according to claim 9, wherein the legs comprise a web-girder structure and the locking device is associated with the web-girder structure of the corresponding leg.

* * * * *